US006139112A

United States Patent [19]

Parrott

[11] Patent Number: 6,139,112

[45] Date of Patent: Oct. 31, 2000

[54] MINING MACHINE WITH INTERNAL WATER SUPPLY FOR THE CUTTING DRUMS

[75] Inventor: George Albert Parrott, Barnsley, United Kingdom

[73] Assignees: Minnovation Limited, United Kingdom; Kennametal, Inc., Latrobe, Pa.

[21] Appl. No.: 09/189,498

[22] Filed: Nov. 10, 1998

[30] Foreign Application Priority Data

Nov. 28, 1997 [GB] United Kingdom ..... 9725188

[51] Int. Cl.[7] ..... E21C 35/23

[52] U.S. Cl. ..... 299/81.1; 299/81.2; 299/81.3

[58] Field of Search ..... 299/81.1, 81.2, 299/81.3, 12

[56] References Cited

U.S. PATENT DOCUMENTS 3,698,769 10/1972 Amoroso ..... 299/81.3 X
3,876,254 4/1975 Parker ..... 299/81.2
4,836,613 6/1989 Adam ..... 299/81.2
5,098,166 3/1992 Ebner et al. ..... 299/81.2
5,507,565 4/1996 LeBegue et al. .
5,690,392 11/1997 Clapham .

FOREIGN PATENT DOCUMENTS 3609754 9/1987 Germany .

*Primary Examiner*—Eileen Dunn Lillis
*Assistant Examiner*—Sunil Singh
*Attorney, Agent, or Firm*—Trexler, Bushnell, Giargiogi & Blackstone, Ltd.

[57] ABSTRACT

A continuous type mining machine which includes a pair of articulated support arms extending forwardly from a self-propelled chassis and rotatably carrying a transverse drive shaft divided into two half-shafts, on which a central drum between the two arms, and an end drum beyond each arm, are mounted, the drums being provided externally with a plurality of replaceable mineral cutter picks, and with a plurality of water spray nozzles, and also having a water supply network to the nozzles. The machine includes a third support arm, which incorporates a water supply, located between the pair of articulated support arms.

11 Claims, 6 Drawing Sheets

14
16
13
15
16
4R
12R
17
18

MINING MACHINE WITH INTERNAL WATER SUPPLY FOR THE CUTTING DRUMS

BACKGROUND OF THE INVENTION (1) Field of the Invention.

This invention relates to a mining machine of the so-called continuous miner type used for the winning of minerals and/or for the driving of underground roadways or tunnels.

(2) Description of Prior Art

Continuous miners comprise a self-propelled chassis usually incorporating endless tracks, with a pair of spaced-apart, forwardly directed, parallel support arms pivotally attached at one end to the chassis and at the other end rotatably supporting a transverse shaft on which is mounted one or more rotary cutting drums provided with a plurality of picks, (the usual configuration being a central drum between the two arms, and an end drum beyond each arm), with a power train extending along each support arm to the shaft to rotate the drums, and with the arms being elevatable by hydraulic rams under the control of a machine operator.

For shearer type mining machines it has long been conventional to provide a water supply internally to the rotary cutting head for various advantageous purposes such as pre-start warning, dust suppression, pick cooling, incendive sparking suppression and/or air flow, but with continuous miners there is no ready access to introduce a water supply. With the construction proposed in GB 2296271 two half-shafts are employed, and a water supply route is down each arm, but the use of a relatively large diameter water seal, with resulting relatively high peripheral speed and rate of wear has been unavoidable. With other continuous miners water supply internally to the cutting drums has been avoided and such machines have been provided with a simple but less effective, spray bar intended to direct water spray to the vicinity of the rotary cutting drums.

One prior art proposal for introducing water externally to the cutting drums of continuous miners whereby any leakage or seal failure is not catastrophic as far as bearings and gearing is concerned because leaking water simply falls to the mine floor rather than contaminates bearings, gearing etc., is described in GB 2297989, but again a relatively large diameter water seal is unavoidable. Large diameter mechanical seals are also unavoidable in GB 2296271.

OBJECT OF THE INVENTION

A basic object of the present invention is to provide a continuous type mining machine in which a water supply, for emission at spray nozzles of the rotary cutting drums, may be safely provided internally of the drums.

SUMMARY OF THE INVENTION

According to the present invention, a continuous type mining machine comprises a pair of articulated support arms extending forwardly from a self-propelled chassis and rotatably carrying a transverse drive shaft divided into two half-shafts, on which a central drum between the two arms, and an end drum beyond each arm, are mounted, the drums being provided externally with a plurality of replaceable mineral cutter picks, and with a plurality of water spray nozzles, and also having a water supply network to the nozzles, is characterised in that (i) a third support arm, which incorporates a water supply, is located between the pair of conventional support arms;

(ii) each half-shaft is rotatably supported between one conventional support arm and the third arm;

(iii) the central drum is divided into two halves, one half carried by each half-shaft;

(iv) a non-rotatable water supply tube extends co-axially along each half-shaft, each water supply tube having an inlet end at an exposed, inner end of each half-shaft and an outlet end with which a rotary seal is associated; and (v) water is supplied from a terminal end of the third arm to the inlet end of each water supply tube with a non-rotatable water seal between the terminal end of the third arm and the inlet end of the water supply tube, and a relatively small diameter rotary water seal at the outlet end of each water supply tube delivering water to a water supply network of its associated end drum, from which end drum network water is fed back along each half-shaft to a water supply network of its associated central drum half.

Thus, by using half-shafts to permit their inner ends to be exposed, and running a non-rotatable water supply tube co-axially from one end to the other of each half-shaft, the machine of the invention may be fitted with relatively small diameter, low wear water seals of the kind used in shearer type cutting drums, and hence of proven reliability.

Although multiple water supply third arms could be provided, preferably only one third arm is provided, being located within the central drum halves, and providing a bearing and/or support annulus that is concentric with the half-shafts and carries bearings for the inner ends of the half-shafts. Preferably, a geared, power-transmitting connection extends between the half-shafts and/or the two central drum halves and is supported by the bearing and/or support annulus, whereby the full power of both e.g. 150 kW electric motors, conventionally provided on the machine is available across all the drums. Preferably, the inner ends of each half-shaft are spaced-apart to define an accommodation space for an extension of the third arm carrying bearing means, having an axis of rotation offset from the half-shaft axis of rotation, for the geared, power transmitting connection.

The geared power transmitting connection may comprise an externally toothed gear wheel that is common to, and in mesh with, an internally toothed gear wheel attached to the inner end of each half-shaft.

Preferably, the opposite sides of the terminal end of the third arm comprises a pair of female delivery bores, into each of which an inlet end of one of the water tubes is engaged, with a static water seal between each delivery bore and the associated inlet end of its water tube. Preferably, a support flange of the third arm projects into the annulus, to opposite sides of which flange are secured wings. Preferably, each intermediate piece incorporates a water transfer network comprising a water inlet port in fluid flow communication with an outlet port of the flange, and the water delivery bore. Preferably, each intermediate piece houses one end of a common shaft that is parallel to, but offset from, the axis of rotation of the half-shafts, which common shaft carries bearings for supporting the power transfer gear. Preferably, a second and rotatable water supply tube co-axially surrounds the non-rotating tube, and the exterior of the rotatable tube together with the interior of a tube-accommodating axial bore of each half-shaft, define a water supply annulus for the water supply network of the central drum halves, with water flow being outwardly along the non-rotatable tube, and then inwardly along the water supply annulus. Preferably, a rotary water seal is provided between the outer end of the static supply tube and a portion of a rotary element of the end drum.

BRIEF DESCRIPTION OF THE DRAWING

The invention will now be described in greater detail by way of example with reference to the accompanying drawings, in which.

DESCRIPTION OF THE PREFERRED EMBODIMENTS

Figure 1:
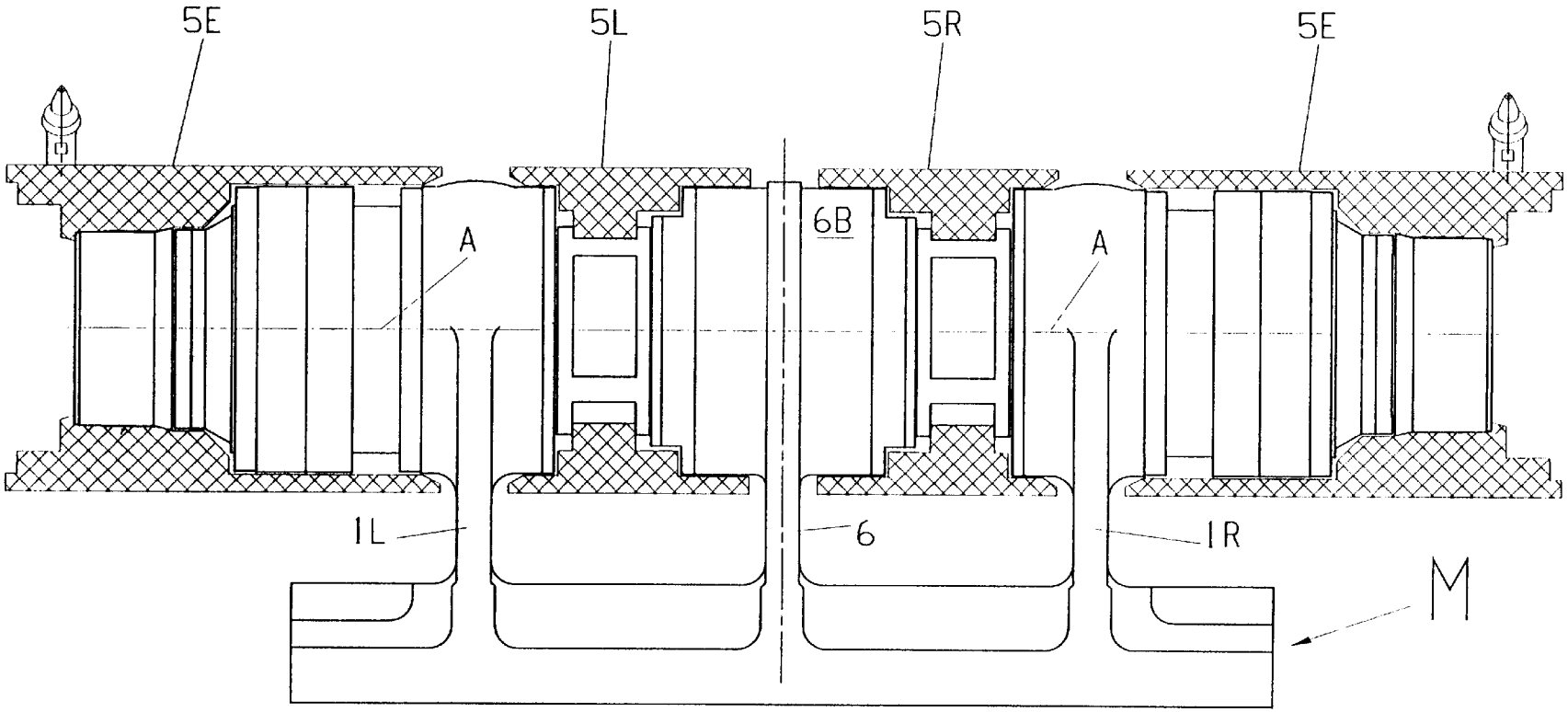
FIG. 1 is a plan view of a portion of a continuous mining machine.

In the drawings, a continuous miner type mining machine M comprises a pair of conventional, parallel support arms 1L and 1R respectively at the left and right hand sides of FIG. 1, which arms are pivotally attached, on coaxial axes, to a conventional, self-propelled chassis (not shown) of the mining machine M, with the arms 1L and 1R projecting forwardly of the chassis and with their elevation being controlled by means of hydraulic rams, in a known manner. The arms 1L and 1R provide two functions, the first function being the lateral support of a plurality of cutting drums, and the second function being the housing of a power transmission from a power source, e.g. a diesel engine or electric motor(s), on the chassis, the transmission comprising a drive shaft rotatable about axis 2 terminating in a bevel gear 2A in mesh with a bevel gear 3 to convert the rotation through 90° Between the arms 1L and 1R, a central drum is divided into two drum halves 5L and 5R, whilst, beyond each arm 1L and 1R, an end drum 5E is provided. Also in accordance with the invention, the conventionally provided transverse drive shaft is divided into two half-shafts 4L, 4R, both rotatable about the same axis A. In detail, one bevel gear 3 is mounted on a left-hand half shaft 4L and the other on a right-hand half shaft 4R, the shafts 4L and 4R being co-axial. It will be appreciated that, if required, additional speed reduction gearing can be incorporated. Thus, drive torque is transmittable between the shafts 2 to the shafts 4L and 4R. On each shaft 4L and 4R is spline mounted one central drum half 5L, 5R, and an end drum 5E, the drums carrying, externally, pick boxes 5B in turn carrying replaceable mineral cutter picks 5C. Each drum also carries a plurality of water spray nozzles 5D which conveniently are mounted in all, or selected ones of, the pick boxes 5B to facilitate emission of a water spray in the vicinity of the picks 5C.

In accordance with a basic feature of the invention, a third support and water supply arm 6 is positioned between the two support arms 1L and 1R, the third arm 6 having a water supply bore 6A. Inner ends 4A of each half-shaft 4L, 4R, are spaced-apart to define an accommodation space for, amongst other things, a bearing annulus 6B which is provided at a terminal end of the arm 6 which is located within the central drum halves 5L and 5R. The annulus 6B has an externally toothed gear 7 mounted in bearings 7A non co-axially for rotation about axis B which is parallel to, but offset from, the axis of rotation A of the half shafts 4L and 4R. The gear 7 has respectively, left-hand and right-hand gear teeth 7L and 7R so as to constitute a bridging gear to provide a drive power connection between the left-hand and right-hand shafts 4L and 4R. Although a single gear 7 is illustrated in FIG. 1, multiple gears, e.g. planetary system, could be provided if required. In the example detailed in FIG. 1, the externally toothed gear wheel 7 is in mesh with internally toothed gear wheels 8L and 8R which are splined to the left and right-hand shafts 4L and 4R, thus providing the powered drive connection between these two shafts which are supported in bearings 9 carried by static housings 10L and 10R which in turn are rigidly mounted on the terminal end of the third arm 6.

The non-coaxial, or offset location of the gear wheel 7 results in inner ends 4A of each half shaft 4L and 4R being exposed and hence accessible, and to take advantage of this access, a support flange 6C of the terminal end of the third arm 6 projects into the annulus 6B and is provided on its opposite sides with wings 11, projecting into the gaps to each side of the bridging gear 7 between the half-shaft ends 4A and the gear 7, and employed as a means of entering a water network (in the form of drilled bores) into the axis and centre of the cutter drums 5 etc. Into each wing 11 is machined a female delivery bore 22 to accept an inlet end 23 of a non-rotatable, water tube 12L and 12R extending along each half shaft 4L and 4R and, which non-rotatable water tubes 12L and 12R permit the use of long-life static seals S preferably constituted by "O"-rings, in the wings 11, with the non-rotatable water tubes 12L, and 12R extending through the drive shafts 4 to the outer extremities of the transmissions, at both the left-hand and right-hand sides. The outer ends of the tubes 12L and 12R are supported in a distribution plate 13 which is rigidly connected to the adjacent end drum 5E and thus rotates about the axis of the water tubes and houses a relatively small diameter rotary seal 14 and any water leakage at this seal is of no consequence.

An outlet end 15 of each water tube 12L, 12R, provides for water flow to a water supply network 16 of the end drum 5E. A second, rotary tube 17, co-axial with the tube 12R, defines an annular return water flow passage 18 receiving water from the network 16 and delivering to a water supply network of drum 5R via a radial connection port 19.

Figure 2:
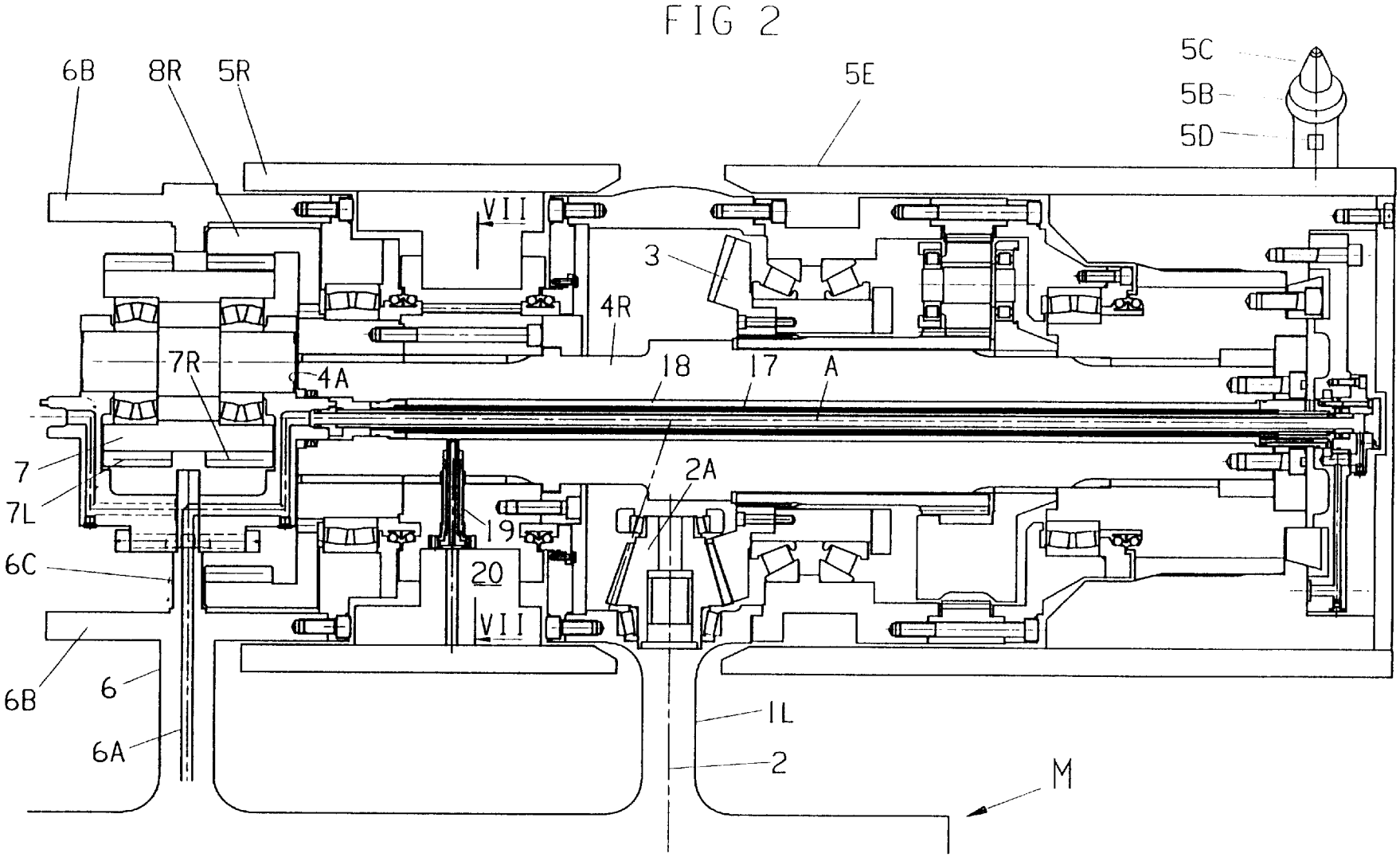
FIG. 2 is a part sectional view, to a larger scale, of the centre to right-hand side of FIG. 1.
Figure 4:
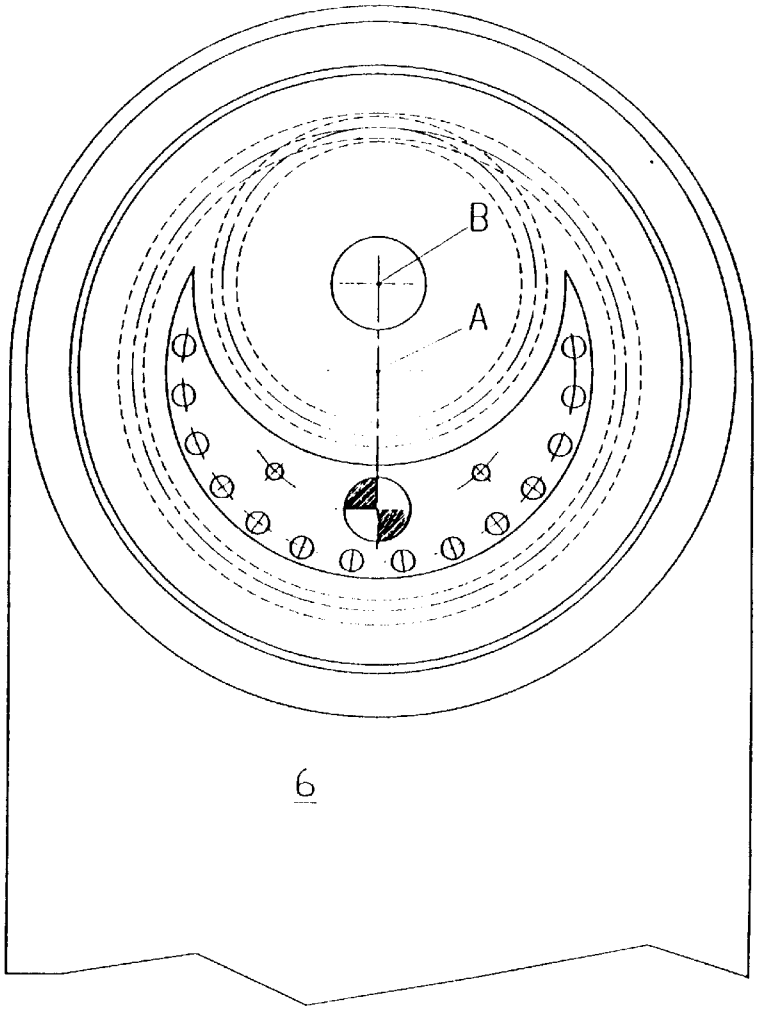
FIG. 4 is an end elevation of FIG. 3.
Figure 7:
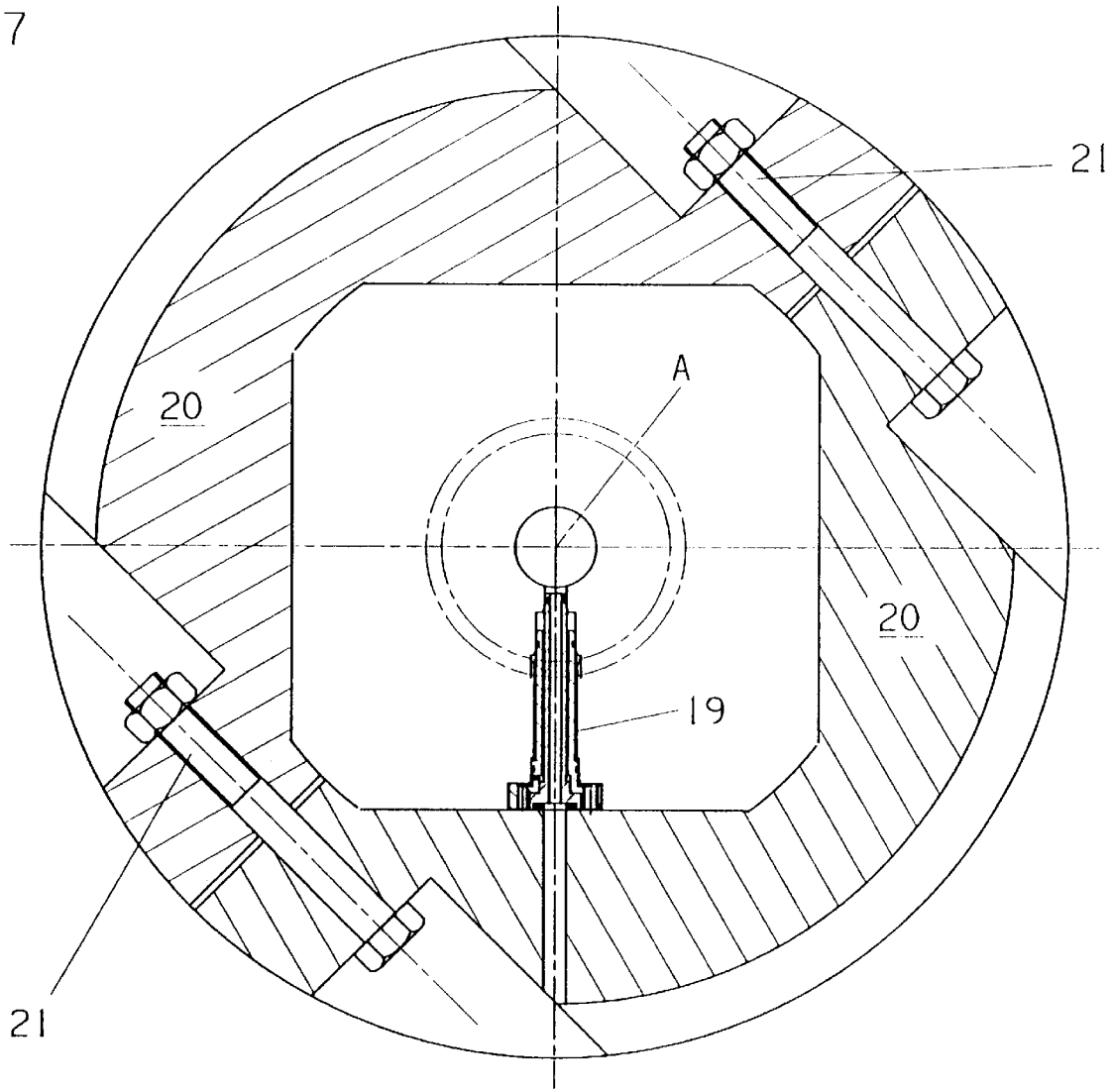
FIG. 7 is a sectional view in the direction of line VII—VII of FIG. 2, to a larger scale than FIG. 2.

FIGS. 2 and 7 illustrate the mounting of drums 5L, 5R, on a square drive collar 20 splined to the shaft 4A and secured in two halves by bolts 21.

In practice, water (which may be produced at a predetermined pressure by an on-board water pump of the machine 1) is conveyed from the chassis to the inlet end (not shown) of the bore 6A of the third arm 6, and passes via wings 11 and tubes 12L and 12R into the left and right-hand distribution plates 13. Water then enters the outer drums 5E which are further drilled to form part of the water supply network connected to the water spray nozzles 5D.

The outer drums 5E and/or their mounting means are also employed to connect, e.g. by drillings, to an eccentric drilling in the drive shaft 4, which drilling is used to connect water supply to the inner drums 5L and 5R which, similarly to the outer drums 5E have a water supply network provided by suitable drillings, to convey water to the spray nozzles 5D.

Figure 3:
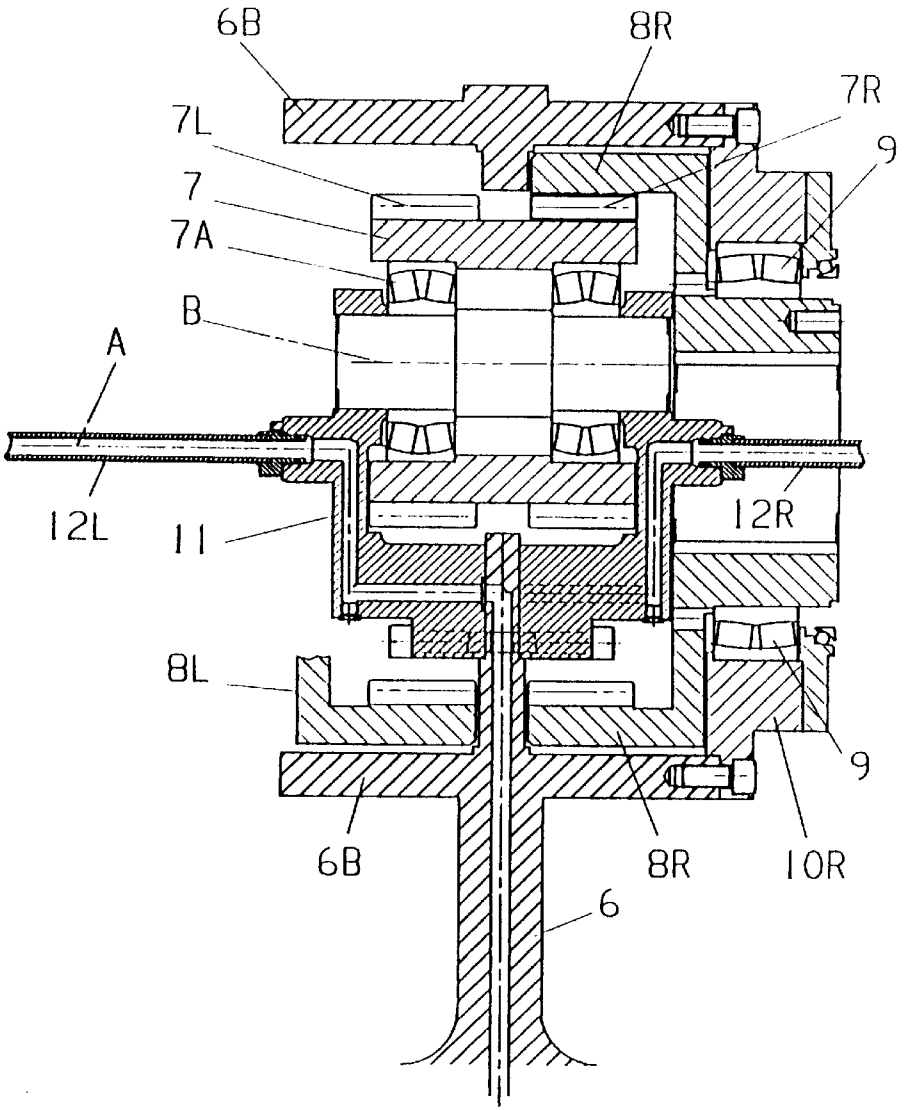
FIG. 3 is a part sectional view, to a yet larger scale, of the centre portion of FIG. 1.
Figure 5:
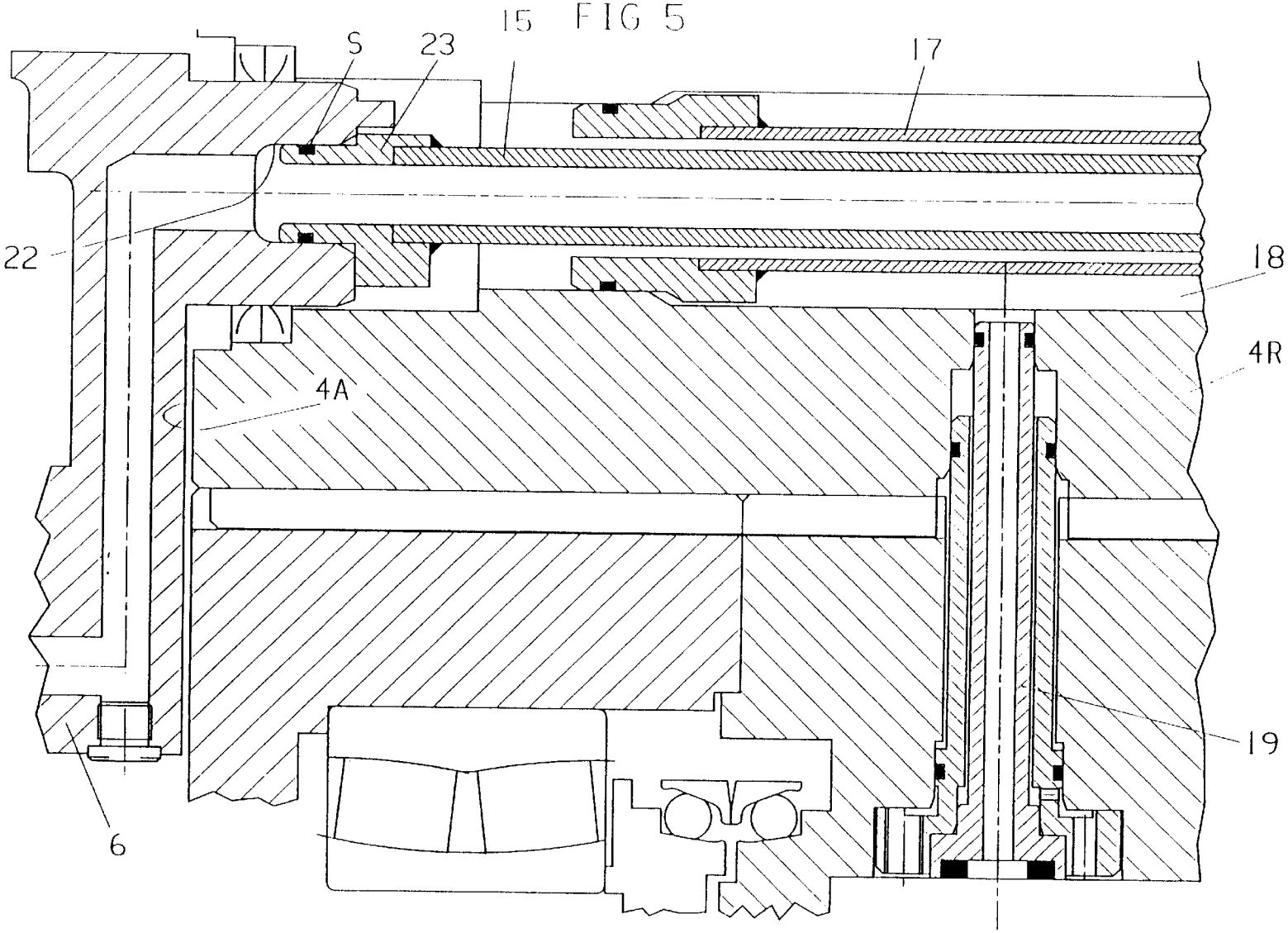
FIG. 5 is a part sectional view, to a yet larger scale, of the left-hand portion of FIG. 2.
Figure 6:
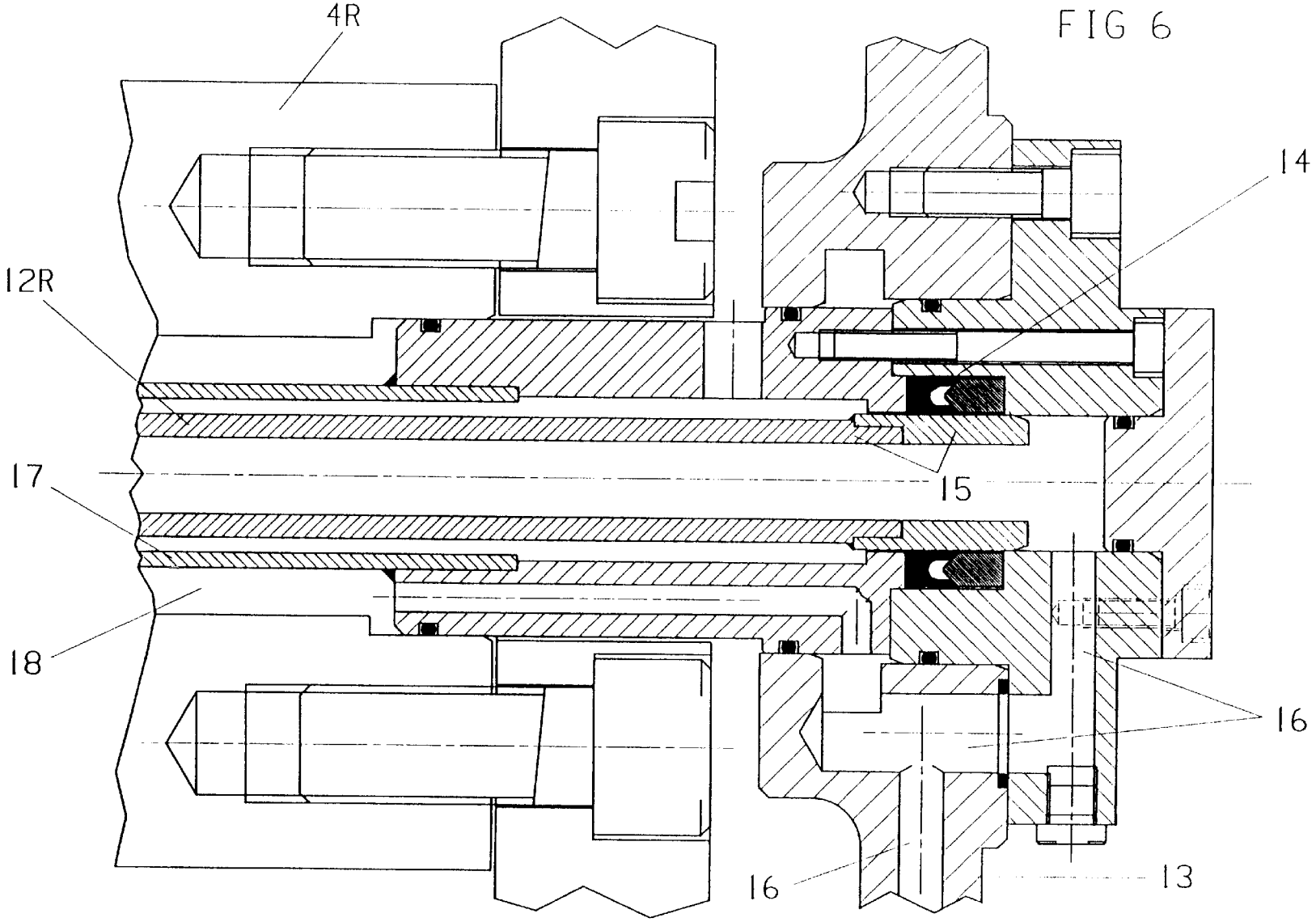
FIG. 6 is a part sectional view, to a yet larger scale, of the right-hand portion of FIG. 2.

Whilst FIG. 3 illustrates a bridging gear 7 driving an internal gear, it could equally be used to transmit to an external gear.

What I claim is:

1. A continuous mining machine comprising a self-propelled chassis, a pair of articulated support arms, extending forwardly from said chassis, a transverse drive shaft divided into two half-shafts and rotatably carried by said arms, a central drum mounted between said two arms, and an end drum mounted beyond each said arm, a plurality of replaceable mineral cutter picks provided externally on said drums, and a plurality of water spray nozzles provided externally on said drums, and a water supply network to the nozzles also provided in said drums, wherein:

(i) a third support arm, which incorporates a water supply, is located between said pair of articulated support arms;

(ii) each said half-shaft is rotatably supported between one articulated support arm and said third arm;

(iii) said central drum is divided into two halves, one half carried by each of said half-shafts;

(iv) a non-rotatable water supply tube extends co-axially along each said half-shaft, each said water supply tube having an inlet end at an exposed, inner end of each said half-shaft and an outlet end; and (v) water is supplied from a terminal end of said third arm to said inlet end of each said water supply tube, with a non-rotatable water seal between said terminal end of said third arm and said inlet end of said water supply tube, and water is delivered by said water supply network to its associated end drum, from which the water is fed back along each said half-shaft to the water supply network of its associated central drum half.

2. A machine as claimed in claim 1, wherein, the terminal end of the third support arm is located within said central drum halves, and provides at least one of a bearing and support annulus that is concentric with said half-shafts and carries bearings for inner ends of said half-shafts.

3. A machine as claimed in claim 2, wherein a geared, power-transmitting connection extends between at least one of said half-shafts and said two central drum halves and is supported by at least one of said bearing and support annulus.

4. A machine as claimed in claim 3, wherein said inner ends of each said half-shaft are spaced-apart to define an accommodation space for an extension of said third arm carrying bearing means having an axis of rotation offset from the axis of rotation of said half-shaft, for said geared, power transmitting connection.

5. A machine as claimed in claim 4, wherein said geared power transmitting connection comprises an externally toothed gear wheel that is common to, and in mesh with, an internally toothed gear wheel attached to said inner end of each said half-shaft.

6. A machine as claimed in claim 2, wherein opposite sides of said terminal end of said third arm comprise a pair of female delivery bores, into each of which said inlet end of one of said water tubes is engaged, with said static water seal between each said delivery bore and said associated inlet end of its said water tube.

7. A machine as claimed in claim 2, wherein a support flange of said third arm projects into said annulus, wings being secured to opposite sides of said support flange.

8. A machine as claimed in claim 7, wherein each said wing incorporates a water transfer network.

9. A machine as claimed in claim 7, wherein each said wing houses one end of a common shaft that is parallel to, but offset from, the axis of rotation of said half-shafts, which common shaft carries bearings for supporting an externally toothed gear wheel.

10. A machine as claimed in claim 1, wherein a second and rotatable water supply tube co-axially surrounds said non-rotating water supply tube, and an exterior of said rotatable tube together with an interior of a tube-accommodating axial bore of each half-shaft, define a water supply annulus for said water supply network of said central drum halves, with water flow being outwardly along said non-rotatable water supply tube, and then inwardly along said water supply annulus.

11. A machine as claimed in claim 1, wherein a rotary water seal is provided between said outlet end of said non-rotatable water supply tube and a portion of a rotary element of its associated end drum.

* * * * *